US007056165B2

(12) United States Patent
Saito

(10) Patent No.: US 7,056,165 B2
(45) Date of Patent: Jun. 6, 2006

(54) CONTROL SYSTEM FOR OUTBOARD MOTOR

(75) Inventor: Chitoshi Saito, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/881,735

(22) Filed: Jun. 30, 2004

(65) Prior Publication Data

US 2005/0042947 A1 Feb. 24, 2005

(30) Foreign Application Priority Data

Jun. 30, 2003 (JP) ..... 2003-188020
Apr. 19, 2004 (JP) ..... 2004-123202

(51) Int. Cl.
*B63H 23/00* (2006.01)

(52) U.S. Cl. ..... 440/1; 440/87; 123/339.23

(58) Field of Classification Search ..... 440/1, 440/2, 87; 123/339.19, 339.22, 339.23
See application file for complete search history.

(56) References Cited

U.S. PATENT DOCUMENTS 4,359,983 A * 11/1982 Carlson et al. ..... 123/339.26
4,566,415 A 1/1986 Iwai et al. ..... 123/361
4,708,669 A 11/1987 Kanno et al. ..... 440/1
4,734,065 A 3/1988 Nakahama et al. ..... 440/1
4,759,731 A 7/1988 Uchida et al. ..... 440/1
4,767,363 A 8/1988 Uchida et al. ..... 440/1
4,931,025 A 6/1990 Torigai et al. ..... 440/1
4,986,236 A * 1/1991 Kobayashi ..... 123/339.13
5,136,279 A 8/1992 Kanno ..... 324/547
5,314,362 A 5/1994 Nagahora ..... 440/86
5,603,301 A 2/1997 Sakurai et al. ..... 123/430
5,615,661 A 4/1997 Suzuki ..... 123/688
5,623,904 A 4/1997 Matsumoto ..... 123/339.23
5,630,394 A * 5/1997 Grizzle et al. ..... 123/339.23
5,715,794 A 2/1998 Nakamura et al. ..... 123/305
5,738,074 A 4/1998 Nakamura et al. ..... 123/305
5,765,528 A * 6/1998 Kamimaru ..... 123/339.19
5,769,060 A 6/1998 Matsumoto ..... 123/585
5,778,857 A 7/1998 Nakamura et al. ..... 123/406.37
5,918,584 A 7/1999 Kato ..... 123/681
5,937,825 A 8/1999 Motose ..... 123/406.13
6,015,319 A 1/2000 Tanaka ..... 440/84
6,030,261 A 2/2000 Motose ..... 440/84
6,109,986 A * 8/2000 Gaynor et al. ..... 440/1
6,375,525 B1 4/2002 Kanno ..... 440/87
6,415,766 B1 7/2002 Kanno et al. ..... 123/339.19
6,491,032 B1 12/2002 Kanno ..... 123/680
6,508,680 B1 1/2003 Kanno ..... 440/1
6,520,147 B1 2/2003 Kanno ..... 123/339.23
6,520,167 B1 2/2003 Kanno ..... 123/674
6,578,548 B1 * 6/2003 Kohn ..... 123/339.23
6,599,158 B1 * 7/2003 Shidara et al. ..... 440/1
6,659,079 B1 * 12/2003 Price ..... 123/339.21
6,709,302 B1 3/2004 Yanagihara ..... 440/1
6,733,350 B1 5/2004 Iida et al. ..... 440/84
6,790,107 B1 * 9/2004 Tanaka ..... 440/1
6,817,338 B1 * 11/2004 Janic et al. ..... 123/339.19
6,948,989 B1 * 9/2005 Watabe ..... 440/87

* cited by examiner

*Primary Examiner*—Lars A. Olson
(74) *Attorney, Agent, or Firm*—Knobbe, Martens, Olson & Bear LLP

(57) ABSTRACT

The control system establishes an engine warm-up protocol based, at least in part, on elapsed time from engine start. The control system provides a reduced reliance on engine temperature as a basis for determining an appropriate engine idle speed. The control system thus reduces the likelihood of unstable idling conditions when, for example, inadequate cooling water or extremely cold cooling water is being supplied to the engine.

26 Claims, 5 Drawing Sheets

CONTROL SYSTEM FOR OUTBOARD MOTOR

RELATED APPLICATION

This application claims priority to Japanese application Serial No. JP2003-188020, filed on Jun. 30, 2003, and JP2004-123202, filed on Apr. 19, 2004, the entire contents of which are hereby expressly incorporated by reference.

BACKGROUND OF THE INVENTION

1. Field of the Invention

The present invention generally relates marine engines and, more particularly, relates to marine engines used in motors designed for low speed trolling operation.

2. Description of the Related Art

Outboard motors frequently propel watercraft while running at an engine speed slightly above or slightly below a neutral idle engine speed. Such operation is commonly called trolling. During trolling, a conventional engine control unit (ECU) for the outboard motor seeks to achieve a target engine idling speed. The ECU may manipulate a secondary air valve that opens and closes an air bypass around the main throttle valve such that the idling engine speed, or trolling engine speed, can be adjusted higher or lower.

In some instances, the target engine speed is determined based upon a reference engine speed stored in memory and is able to be adjusted based upon operator input. In other words, a reference engine speed is used unless that reference engine speed is increased or decreased by manual input from an operator of the outboard motor. In many instances, the reference engine speed is determined based upon a detected engine operating temperature with the reference engine speed generally decreasing as the engine operating temperature increases.

Outboard motors are typically water-cooled. Since watercraft are designed to float upon bodies of water, the surrounding water is a convenient source of cooling water for outboard motors. Thus, open loop cooling systems are common within the industry. The open loop cooling systems, however, sometimes deliver water that is substantially colder than the engine was designed and the colder water can retard the warming up of the engine. In such arrangements, the assumed engine temperature may be higher than the actual engine temperature. Thus, the ECU may be fooled into believed a warmed-up condition has been achieved and may set the idle speed lower than desired for the actual engine operating temperature. The lower idle speed can cause the engine to stall due to the relatively higher than expected friction forces in the engine due to the lower temperature.

SUMMARY OF THE INVENTION

Accordingly, a control system for a marine engine is desired in which stable idle speed operation can be maintained even if the engine has not achieved a truly warmed up operating temperature.

The preferred embodiments of the present control system for outboard motor have several features, no single one of which necessarily is solely responsible for their desirable attributes. Without limiting the scope of this control system as expressed by the claims that follow, its more prominent features will now be discussed briefly. After considering this discussion, and particularly after reading the section entitled "Detailed Description of the Preferred Embodiments," one will understand how the features of the preferred embodiments provide advantages, which may include the reducing the likelihood of unstable idling conditions even when the engine temperature changes before the engine is completely warmed-up, the allowance for the watercraft operator to at least increase the engine idle speed without creating unstable idling conditions, even when the engine is not completely warmed-up, the allowance for the watercraft operator to set the target engine idle speed after stable idling conditions have been established, the assurance that the engine warms-up completely regardless of any changes in the engine temperature or in the reference engine idle speed at the engine start, the automatic reset of the input engine idle speed when the engine speed is a predetermined value or higher and the automatic reset of the input engine idle speed when the engine is stopped.

One aspect of the present invention involves a control system for an outboard motor that comprises an engine. The outboard motor is adapted to propel a watercraft with thrust produced by an engine-driven propeller. The control system comprises an operability sensor and at least one engine idle sensor. The operability sensor is adapted to detect whether the watercraft is operable. The engine idle sensor is adapted to detect whether the engine is idling. The control system further comprises apparatus adapted to determine an elapsed time after an engine start, and apparatus adapted to determine a reference engine idle speed based on the elapsed time after an engine start and to set the reference engine idle speed. The control system further comprises a controller adapted to adjust an engine idle speed during idle speed running based on the reference engine idle speed, when the operability sensor detects that the watercraft is operable and the engine idle sensor detects that the engine is idling.

Another aspect of the present invention involves a control system for a marine engine. The marine engine comprises an engine body defining at least one cylinder bore in which a piston reciprocates. A cylinder head is secured to a first end of the engine body for closing the cylinder bore. The cylinder head defines, with the piston and the cylinder bore, a combustion chamber. An intake passage is in selective fluid communication with the combustion chamber and is configured to provide air for an air/fuel mixture to the combustion chamber. An air induction system is configured to supply air to the intake passage. At least one sensor is configured to monitor engine running conditions. An engine control unit is configured to determine an elapsed time after an engine start and further configured to control an engine idle speed based upon the engine running conditions and the elapsed time.

A further aspect of the present invention involves a method of operating a marine engine. The marine engine is adapted for driving a marine propulsion device. The method comprises the steps of determining at least one actual engine running condition, determining an elapsed time after an engine start, setting a reference engine idle speed based upon the elapsed time, reading an input engine idle speed, comparing the reference engine idle speed to a preset engine idle speed, setting a target engine idle speed to be one of the reference engine idle speed or the input engine idle speed, and adjusting an actual engine idle speed to be equal to the target engine idle speed.

Another aspect of the present invention involves a control system for a marine engine. The marine engine is adapted to propel a watercraft with thrust produced by an engine-driven propeller. The control system comprises an operability sensor adapted to detect whether the watercraft is operable. At least one engine idle sensor is adapted to detect whether the engine is idling. An apparatus is adapted to determine an elapsed time after an engine start. Another apparatus is adapted to determine a reference engine idle speed based on the elapsed time after an engine start. A controller is adapted to adjust an engine idle speed during idle speed running based on the reference engine idle speed when the operability sensor detects that the watercraft is operable and the engine idle sensor detects that the engine is idling.

An additional aspect of the present invention involves a marine engine for a watercraft. The engine comprises an engine body that defines at least one cylinder bore in which a piston reciprocates. A cylinder head is secured to a first end of the engine body for closing the cylinder bore and defines with the piston and the cylinder bore a combustion chamber. An intake passage is in selective fluid communication with the combustion chamber and is configured to provide air for an air/fuel mixture to the combustion chamber. An air induction system is configured to supply air to the intake passage. At least one sensor is configured to monitor engine running conditions. An engine control unit is configured to determine an elapsed time after an engine start and further is configured to control an engine idle speed based upon the engine running conditions and the elapsed time.

An aspect of the present invention also involves a method of operating an outboard motor for a watercraft. The outboard motor comprises an engine for driving a marine propulsion device. The method comprises determining at least one actual engine running condition; determining an elapsed time after an engine start; setting a reference engine idle speed based at least in part upon the elapsed time; reading an input engine idle speed; comparing the reference engine idle speed to a preset engine idle speed; setting a target engine idle speed to be one of the reference engine idle speed and the input engine idle speed; and adjusting an actual engine idle speed to be equal to the target engine idle speed.

BRIEF DESCRIPTION OF THE DRAWINGS

The preferred embodiments of the present control system for outboard motor, illustrating its features, will now be discussed in detail. These embodiments depict the novel and non-obvious control system shown in the accompanying drawings, which are for illustrative purposes only. These drawings include the following figures, in which like numerals indicate like parts.

DETAILED DESCRIPTION OF THE PREFERRED EMBODIMENTS

Figure 1:
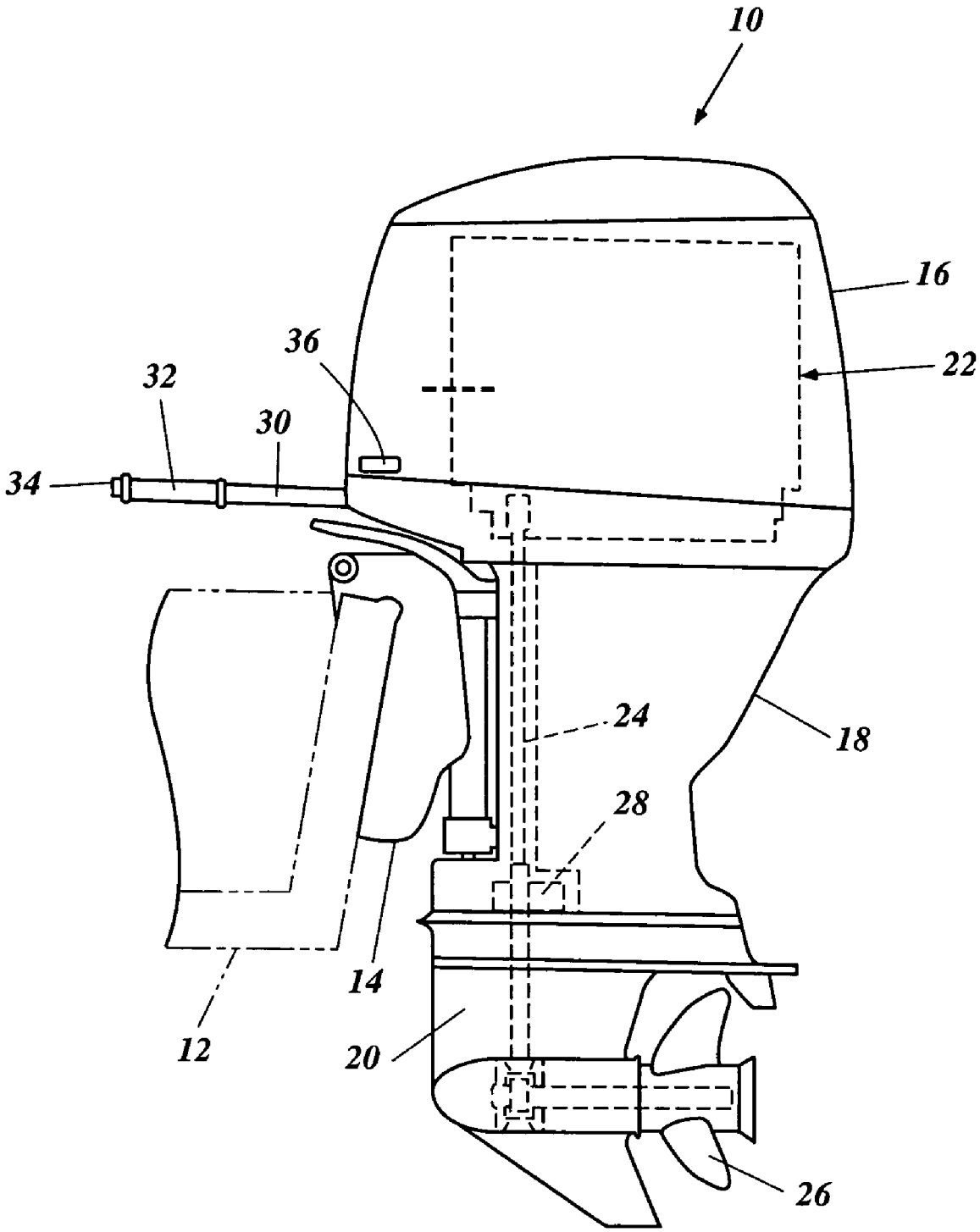
FIG. 1 is a schematic right-side elevation view of an outboard motor including a preferred embodiment of the present engine control unit.

FIG. 1 illustrates, in a schematic view, an outboard motor 10 including the present engine control system. While the present invention is described in the context of an outboard motor, certain features, aspects and advantages can be used with other types of marine engines, including but not limited to those used in stern drive applications, inboard/outboard applications, personal watercraft applications, jet boat applications and the like.

The illustrated outboard motor 10 is mounted to the rear of a watercraft hull 12. In the illustrated embodiment, swivel and clamp brackets 14 mount the outboard motor 10 to the hull 12. The brackets 14 enable the motor 10 to rotate about a substantially vertical axis, such that the motor 10 is able to steer the watercraft 12. The brackets 14 also enable the motor 10 to tilt relative to the hull 12 along a substantially horizontal axis, such that a lower portion of the motor 10 can be moved clear of obstacles as the watercraft 12 is put into and taken out of a body of water, or can be trimmed during operation of the watercraft, for instance. Those of skill in the art will appreciate that alternative apparatus may be used to mount the outboard motor 10 to the hull 12.

With continued reference to FIG. 1, the outboard motor 10 includes a housing comprising a top cowling 16, an upper casing 18 and a lower casing 20. The top cowling 16 contains an engine 22. A drive shaft 24 extends downward from the engine 22, through the upper casing 18 and into the lower casing 20. A lower end of the drive shaft 24 is operably connected to a propeller 26. The engine 22 produces power, or drive torque, which the drive shaft 24 transmits to the propeller 26. The propeller 26 produces thrust to propel the watercraft 12 across a body of water.

A water pump 28, which is attached to an intermediate portion of the drive shaft 24, draws in water from the body of water surrounding the watercraft 12. The water pump 28 supplies the drawn-in water to the engine 22 in order to cool the engine 22. The water pump 28 then discharges the water to the body of water surrounding the watercraft 12. In some arrangements, a closed loop cooling system can be used instead of the above-described open loop cooling system.

A steering rod 30 preferably extends forward from a portion of the body of the outboard motor, such as, for instance, the top cowling 16. A watercraft operator (not shown) can apply lateral torque to the steering rod 30 to rotate the motor 10 relative to the hull 12 about a substantially vertical axis. As the motor 10 rotates, the propulsive force supplied by the propeller 26 guides the watercraft 12 in the desired direction.

An end portion of the steering rod 30 preferably includes an accelerator grip 32. By twisting the accelerator grip 32, the watercraft operator can control the operating speed of the engine 22. For example, to make the watercraft 12 accelerate, the operator twists the accelerator grip 32 in a first direction. The twisting motion preferably controls the opening and closing of a throttle valve 58, which is described in detail below, in any suitable manner. The control mechanism may be purely mechanical, such as cables running from the accelerator grip 32 to the throttle valve 58. Alternatively, the control mechanism may be electronic.

An end of the illustrated accelerator grip 32 includes an idle speed control switch 34. The idle speed control switch 34 preferably controls the opening and closing, or the degree thereof, of a secondary air valve 86, or idle speed control valve, which is described in detail below. The control mechanism may be purely mechanical, such as cables running from the accelerator grip 32 to the throttle valve 58. Alternatively, the control mechanism may be electronic. Moreover, the engine operating speed and the engine idle speed can be controlled from controls located elsewhere on the watercraft, such as near a captain's seat.

The illustrated top cowling 16 further comprises a shift switch 36 for selecting one of forward, reverse or neutral modes of a transmission (not shown). Other operating options also can be provided. In the preferred arrangement, when the switch 36 occupies the forward position, the propeller 26 spins in a first direction to drive the watercraft 12 forward; when the switch 36 occupies the reverse position, the propeller 26 spins in a second direction to drive the watercraft 12 backward; and when the switch 36 occupies the neutral position, the propeller 26 does not spin, regardless of the engine speed.

Figure 2:
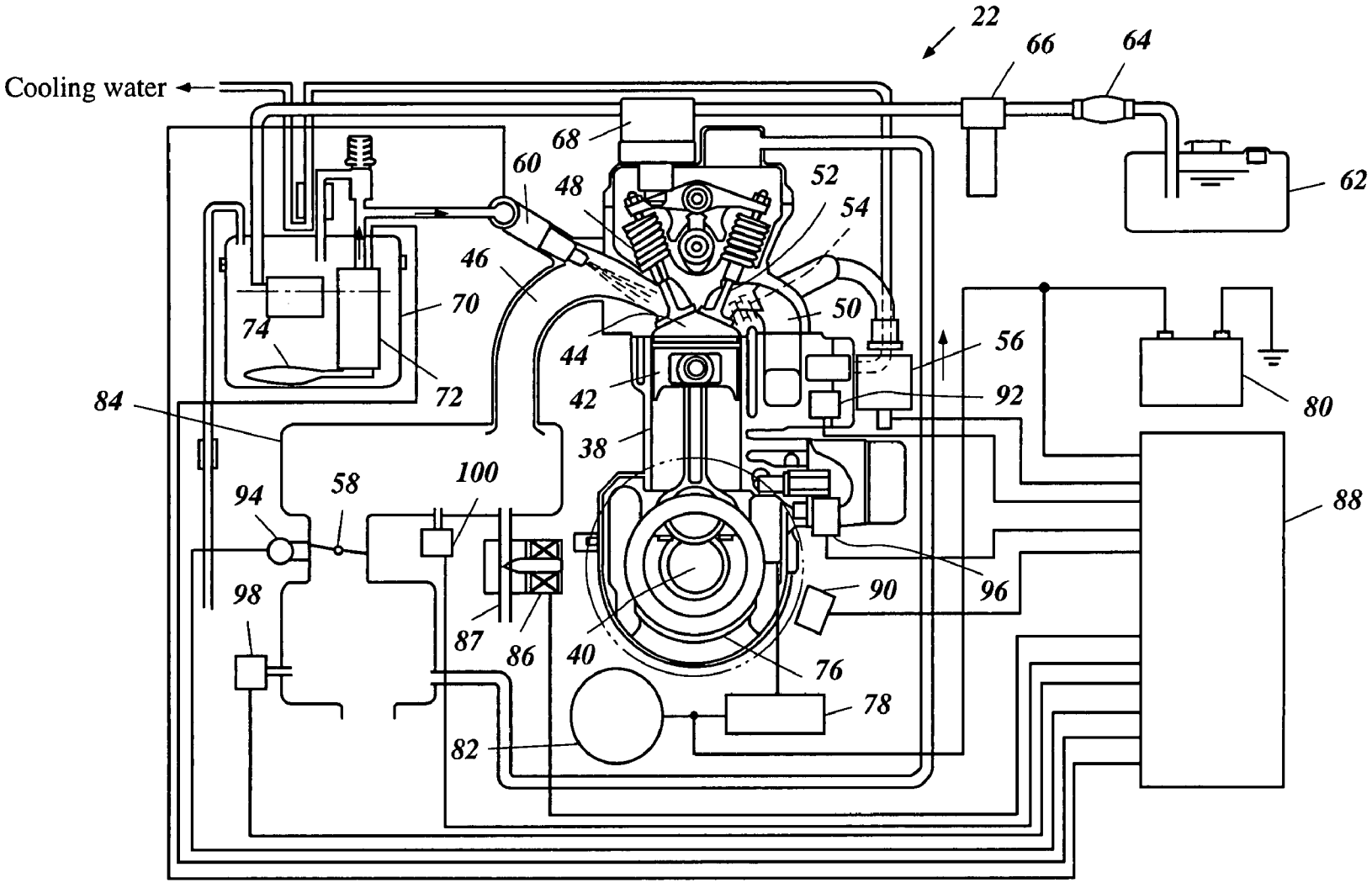
FIG. 2 is a schematic view of the interior of the outboard motor and engine control unit of FIG. 1.

FIG. 2 illustrates, in a schematic view, the engine 22 of FIG. 1, including a preferred embodiment of an exemplary control system. The illustrated engine 22 runs on the four-stroke combustion cycle, and includes a cylinder body 38, a crankshaft 40, a piston 42, a combustion chamber 44, an intake passageway 46, an intake valve 48, an exhaust passageway 50, an exhaust valve 52, a spark plug 54 and an ignition coil 56.

At the inlet side, the intake passageway 46 includes a throttle valve 58 that controls the volume of intake airflow to the combustion chamber 44. As the air intake volume increases, the engine speed accelerates, and as the intake volume decreases, the engine speed decelerates.

Downstream from the throttle valve 58, the intake passageway 46 comprises a fuel injector 60. A fuel tank 62 supplies fuel to the injector 60 in any suitable manner. In the illustrated arrangement, a primary pump 64 transfers the fuel from the fuel tank 62 through a low-pressure filter 66. A low-pressure fuel pump 68 then transfers the fuel to a secondary fuel tank 70. Finally, a high-pressure fuel pump 72 transfers the fuel through a suction filter 74 and into the injector 60. Water supplied by the water pump 28 can be used to cool the fuel after it has been pressurized by the high-pressure fuel pump 72.

In the illustrated arrangement, a stator coil 76 mounted to the drive shaft 24 generates electric power. The electric power passes through a regulator 78 to be stored in a battery 80. The battery 80 is connected to a starter motor 82. The starter motor 82, drawing power from the battery 80, starts the engine 22 when desired by the operator. The motor 82 may include a kill switch (not shown) for cutting power to the engine 22, such as in emergency situations.

A surge tank 84 positioned between the throttle valve 58 and the intake passageway 46 receives air passing through the throttle valve 58. The air entering the surge tank 84 passes into the intake passageway 46 to be supplied to the combustion chamber 44. A secondary air valve 86 regulates a volume of secondary air flowing into the surge tank 84. The secondary air bypasses the throttle valve 58 and flows directly into the surge tank 84. Preferably, the bypassed air flows through a bypass passage 87 and the secondary air valve 86 controls the air flow through the bypass passage 87.

The secondary air alters idling conditions of the engine 22. Specifically, during idle, the throttle valve 58 either is closed or substantially closed and, as the secondary air valve 86 opens, the volume of secondary air flow supplied to the engine increases. The increased airflow acts to increases the engine idle speed. Vice versa, as the secondary air valve 86 closes and the volume of secondary air flow decreases, the idle speed of the engine decreases.

The secondary air valve 86 may, for example, comprise an electromagnetic solenoid valve. In such a valve, as the amount of electric current supplied to the solenoid increases, the displacement of an armature increases, thus opening the valve 86. Other suitable valve arrangements also can be used. In some configurations, a needle valve, a small butterfly valve or the like can be used.

In the illustrated arrangement, an engine control unit (ECU) 88 controls the operating conditions of the engine 22, including the opening and closing of the secondary air valve 86. The ECU 88 may include a processing unit (not shown) such as a microcomputer or an operation circuit. Furthermore, while a single structure is illustrated, in some arrangements the ECU 88 may comprise a number of discrete processing units or controllers that operate in a coordinated manner. It also is to be noted that the control system may be in the form of a hard wired control circuit. Alternatively, the control system may be constructed of a dedicated processor and a memory for storing a computer program configured to perform the steps recited below. Additionally, the control system may be constructed of a general purpose computer having a general purpose processor and the memory for storing the computer program for performing the desired routines. Preferably, however, the control system is incorporated into the ECU 88, in any of the above-mentioned forms.

The illustrated ECU 88 receives inputs for engine control from various sensors. For example, these sensors may include a crank angle sensor 90, a cooling water temperature sensor 92, a throttle opening sensor 94, a hydraulic pressure sensor 96, an intake air temperature sensor 98 and/or an intake air pressure sensor 100.

The crank angle sensor 90 detects the rotational angle, or phase, of the drive shaft 24. The crank angle sensor 90 may also detect the rotational speed of another rotating shaft, such as the drive shaft 24, for example but without limitation. The selected shaft preferably rotates at the same or a proportional speed to the engine speed. Other suitable structures and arrangements also can be used to detect the speed at which the engine is operating. For instance, signals from a flywheel magneto can be used.

The cooling water temperature sensor 92 detects the temperature of the cooling water, which provides a proxy for the temperature inside the cylinder body 38. Other structures and arrangements also can be used to sense the operating temperature of the engine. For instance, sensors can be positioned within the exhaust system, sensors can be positioned on selected components of the engine or the like.

The throttle opening sensor 94 detects the degree of openness of the throttle valve 58. Other suitable structures and arrangements can also be used to sense operator demand. For instance, position of an input device, such as the twist grip, for instance, can be sensed. In some embodiments, the intake air flow rate or pressure can be sensed.

The hydraulic pressure sensor 96 detects hydraulic pressure generated by a hydraulic pump (not shown). In some arrangements, this sensor can be used as a proxy for engine speed assuming that the hydraulic pressure will increase with engine speed increases.

The intake air temperature sensor 98 detects the temperature of the air entering the throttle valve 58. The intake air pressure sensor 100 detects the pressure of the air in the surge tank 84. These sensors can be positioned in other regions of the intake system.

In order to determine appropriate engine operation control scenarios, the ECU 88 preferably uses control maps and/or indices stored within the ECU 88 in combination with data collected from these and other various input sensors. For example, the shift switch 36 and the idle speed control switch 34 may transmit output signals to the ECU 88. In addition to the previously mentioned sensors, the ECU's various input sensors also can include, but are not limited to, a throttle lever position sensor and an oxygen ($O_2$) sensor. It should be noted that the above-identified sensors merely correspond to some of the sensors that can be used for engine control and it is, of course, practicable to provide other sensors, such as a knock sensor, a neutral sensor, a watercraft pitch sensor, a shift position sensor and an atmospheric temperature sensor. The selected sensors can be provided for sensing engine running conditions, ambient conditions or other conditions of the engine or associated watercraft.

After receiving input signals from the sensors and the various other sources, the ECU 88 outputs control signals to various engine components. For example, the ECU 88 may output control signals to the fuel injector 60, the ignition coil 56, and/or the secondary air valve 86. The ECU also may output signals to lights, buzzers and gauges for feedback to the operator.

Figure 3:
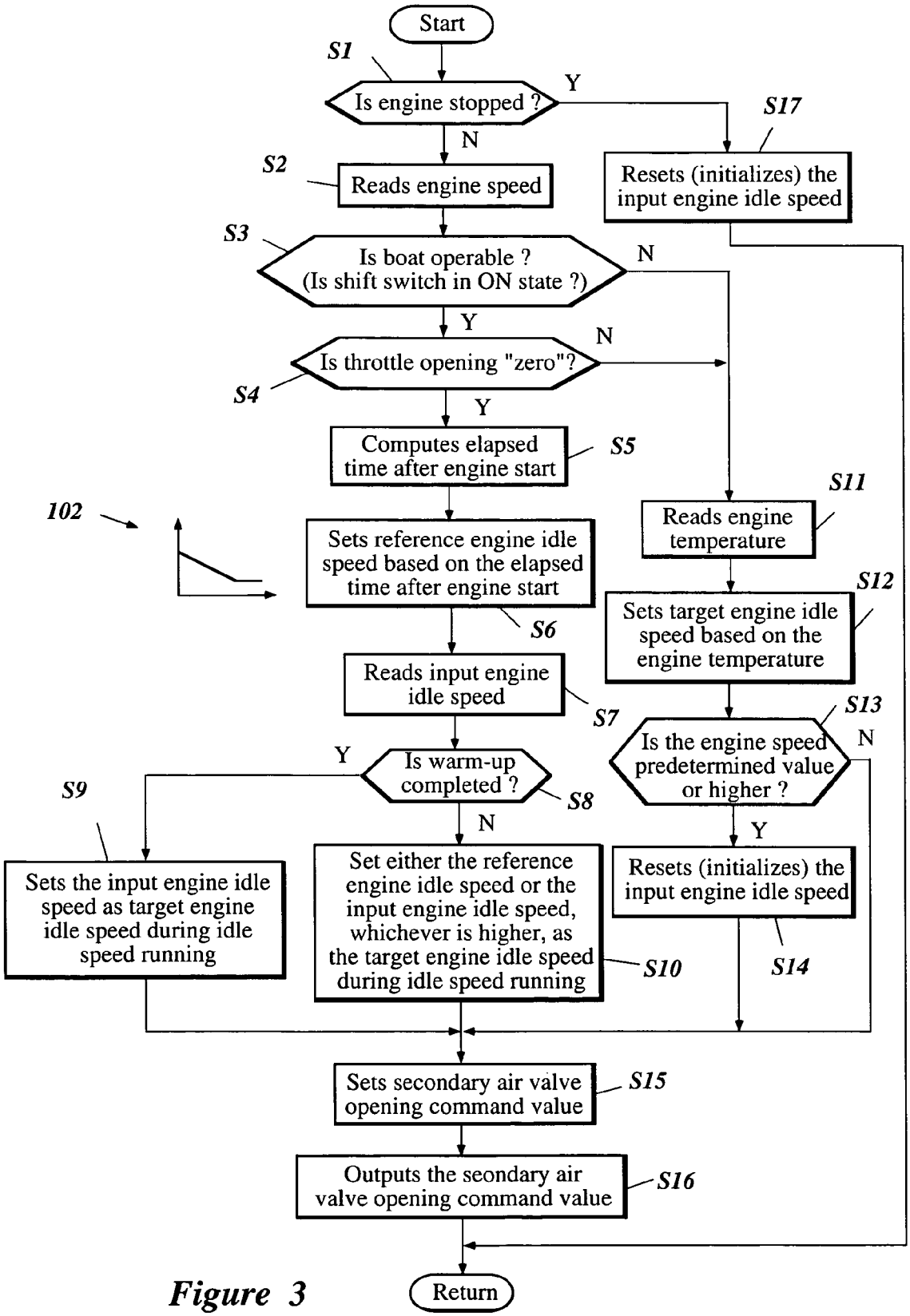
FIG. 3 is a flowchart that diagrams a preferred embodiment of a method for controlling engine idle speed, such as the present control system might carry out.

The ECU 88 executes various processing operations to control the operating conditions of the engine 22, including secondary air valve opening control. FIG. 3 illustrates a flowchart of a preferred processing operation that computes a secondary air valve opening command value and outputs it as a command signal to the secondary air valve 86. This processing operation may, for example, be executed as a timer interrupt process at intervals of prescribed sampling time, ΔT. ΔT may equal, for example but without limitation, approximately 10 milliseconds.

In the processing operation illustrated in FIG. 3, at the first step S1 following initialization, the ECU 88 determines whether or not the engine 22 is stopped. This determination may be based on, for example, a reading from the crank angle sensor of any change in the crank angle. If there is no change in the crank angle over the sampling interval, then the engine 22 is stopped. If the engine 22 is determined to be stopped, the process moves on to step S17, which is described in detail below. If the engine 22 is determined to be running, however, the process moves on to step S2.

At step S2, the ECU 88 determines the engine speed. This determination may be based on, for example, input from the crank angle sensor 90. Other suitable techniques for determining engine speed, by proxy or otherwise, also can be used. The process then moves on to step S3.

At step S3, the ECU 88 determines whether or not the watercraft 12 is operable. This determination may be based on, for example, whether or not the shift switch 36 occupies one of the forward or reverse positions. In some arrangements, the position of a clutching assembly can be sensed. In other arrangements, movement of the propeller shaft can be sensed. Yet other arrangements can use any other suitable technique for determining if the watercraft is operable. If the watercraft 12 is inoperable, the process moves on to step S11, which is described in detail below. However, if the watercraft 12 is operable, the process moves on to step S4.

At step S4, the ECU 88 determines whether or not the opening of the throttle valve 58 is zero or substantially zero. In other words, a determination is made as to whether the throttle valve is in a "closed" position. This determination may be based on, for example, input from the throttle opening sensor 94 or input from a proxy, such as an operator-controlled input device (e.g., a twist grip position) for example but without limitation. If the throttle opening is not zero, meaning that the engine 22 is not idling, the process moves on to step S11. However, if the throttle opening is zero, meaning that the engine 22 is idling, the process moves on to step S5.

At step S5, the ECU 88 determines the elapsed time since the last engine start. For example, the ECU 88 may include a timer (not shown) that resets each time the engine 22 is started. Alternatively, the ECU 88 may compute the elapsed time since the last engine start by multiplying the number of times that the processing operation has been executed since the last engine start by the prescribed sampling time, ΔT. Those of skill in the art will appreciate that the elapsed time could also be determined in other ways.

Figure 4:
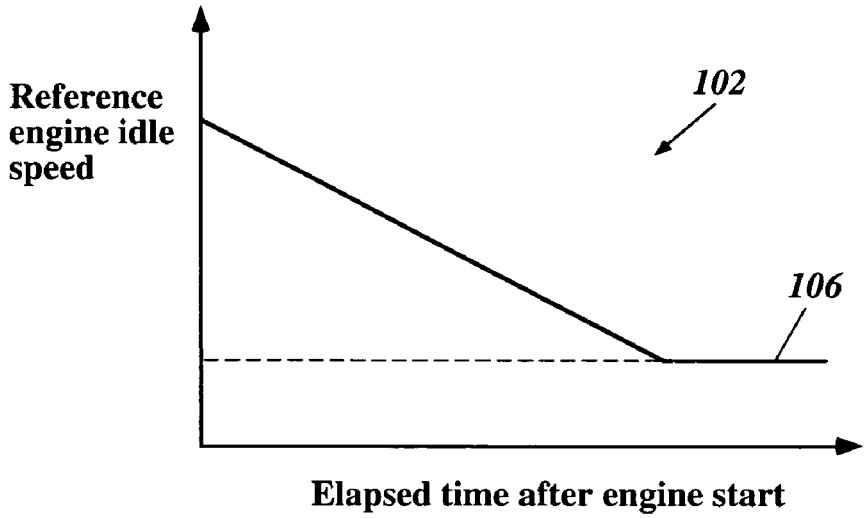
FIG. 4 is a graph illustrating an example of the relationship between elapsed time and reference engine idle speed in the present control system.

After the ECU 88 has determined the elapsed time since the last engine start, the process goes on to step S6. At step S6, the ECU 88 sets a reference engine idle speed. The reference engine idle speed is based on the elapsed time since the last engine start, and is set in accordance with a control map or table of values. For example, the control map 102 of FIG. 4 plots the relationship between the reference engine idle speed and the elapsed time since the last engine start. The control map 104 of FIG. 5 plots the relationship between the appropriate engine idle speed immediately after an engine start (indicated as "engine idle speed at start" in FIG. 5) and the engine temperature.

Figure 5:
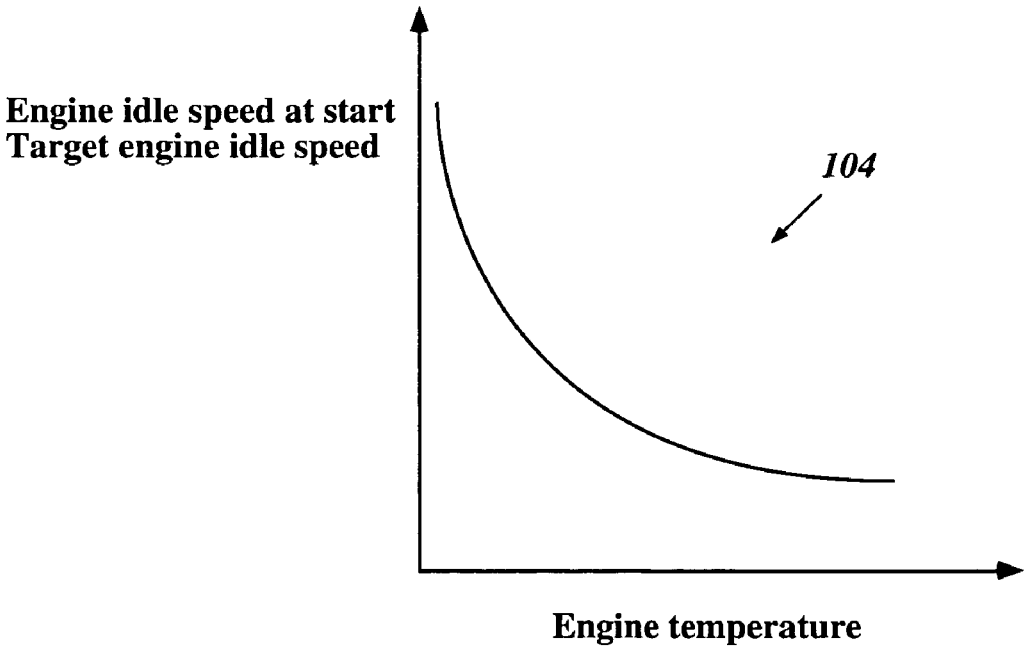
FIG. 5 is a graph illustrating an example of the relationship between engine temperature and target engine idle speed immediately after an engine start in the present control system.

In accordance with a control map, such as the one illustrated in FIG. 5 for example but without limitation, the ECU 88 determines an appropriate engine idle speed immediately after the engine 22 is started. The ECU 88 makes this determination based on the engine temperature. Engine temperature may be detected by the cooling water temperature sensor 92, or any of the other configurations described above. Moreover, other suitable techniques for sensing engine temperature can be used. As the control map of FIG. 5 illustrates, the engine idle speed is configured to decrease as the engine temperature increases. The engine 22 thus tends to idle at a higher speed when the engine temperature is relatively low. The low temperature increases the viscosity of the engine oil, which generates greater friction. The higher idle speed helps to overcome the greater friction, leading to advantageous idling conditions.

After the ECU 88 determines an appropriate engine idle speed, the ECU 88 then sets the actual engine idle speed to be approximately equal to the determined value. As FIG. 4 illustrates, the engine idle speed preferably decreases at a constant rate as the elapsed time from the engine start increases. In this manner, fluctuations in the engine temperature do not adversely change the idle speed of the engine. Due to the decrease in speed over time, the engine idle speed eventually reaches a preset engine idle speed 106 (see FIG. 4). Thereafter, the engine idle speed preferably remains at the preset engine idle speed 106.

The preset engine idle speed 106 is the desired engine idle speed after the engine has warmed-up. Therefore, whether or not the engine warm-up has been completed can be determined by comparing the reference engine idle speed to the preset engine idle speed 106. If the two values are equal, engine warm-up is complete. If the reference engine idle speed is greater than the preset engine idle speed 106, engine warm-up is not yet complete. The time required for the warm-up to be completed can also be computed from the engine idle speed immediately after the engine start, and the predetermined rate at which the reference engine idle speed decreases.

Once the ECU 88 sets the reference engine idle speed, the process moves on to step S7. At step S7, the ECU 88 reads an input engine idle speed from the idle speed control switch 34. The process then moves on to step S8.

At step S8, the ECU 88 determines whether or not the engine 22 has warmed-up completely. As described above, the ECU 88 makes this determination by comparing the reference engine idle speed to the preset engine idle speed. If the warm-up is complete, the process goes on to step S9. If the warm-up is not complete, the process goes on to step S10.

At step S9, the warm-up is complete, so the ECU 88 sets the input engine idle speed, which was read at step S7, as the target engine idle speed during idle speed running. Then, the process goes on to step S15, which is described in detail below.

At step S10, the warm-up is not complete, so the ECU 88 sets the greater of the reference engine idle speed, which was set at step S6, or the input engine idle speed, which was read at step S7, as the target engine idle speed during idle speed running. Then, the process goes on to step S15, which is described in detail below.

Meanwhile, at step S3 or step S4 the operating process may follow a different path from that described above. For example, at step S3 the ECU 88 may receive an input that indicates that the shift switch 36 occupies the neutral position. Alternatively, at step S4 the ECU 88 may receive an input that indicates that the throttle opening is not zero. In either of these scenarios, the process bypasses step S5 and moves to step S11.

At step S11 the ECU 88 determines the engine temperature. For example, the cooling water temperature sensor 92 may output the engine temperature to the ECU 88, as described above. The process then goes on to step S12. At step S12, the ECU 88 sets the target engine idle speed based upon the engine temperature, in accordance with a control map such as the one illustrated in FIG. 5. The process then goes on to step S13.

At step S13, the ECU 88 determines whether or not the engine speed is greater than or equal to a preset value. In some arrangements, the preset value can correlate to a speed indicative of the watercraft being moved at speeds significantly above trolling speeds. The preset value can be stored within a memory location accessible by the ECU 88. In this manner, the operator is free to move the watercraft from trolling location to trolling location without altering the idle speed set in step S12 (see S14). If the engine speed is greater than or equal to the preset value, the process goes on to step S14. If the engine speed is less than the preset value, the process goes on to step S15.

At step S14, the input engine idle speed is reset (initialized). Then, the process goes on to step S 15.

At step S15, the ECU 88 sets a secondary air valve opening command value. This value is based on the engine speed, which was read at step S2, and the target engine idle speed during idle speed running, which was set at step S9 or step S10, or the target engine idle speed, which was set at step S12. The secondary air valve opening command value may depend upon the prevailing secondary air valve opening condition and the prevailing engine speed. In such a case, the secondary air valve opening command value may be set to a secondary air valve opening target value that achieves the target engine idle speed. Once the ECU 88 has set the secondary air valve opening command value, the process goes on to step S16.

At step S16, the ECU 88 outputs the secondary air valve opening command value to the secondary air valve 86. Then, the process returns to the main program.

Meanwhile, at step S1 the ECU 88 may have determined that the engine is stopped. In such an event, the process moves on to step S17. At step S17 the input engine idle speed is reset (initialized). Then, the process returns to the main program.

The processing operation illustrated in FIG. 3 and described above determines that the watercraft 12 is in a state of idle speed running (e.g., trolling) when the watercraft 12 is operable (step S3) and the throttle opening is substantially zero (step S4). According to this processing operation, the ECU 88 controls the engine idle speed during trolling (e.g., idle speed movement of the watercraft) based on the reference engine idle speed (steps S5–S10, S15 and S16). As illustrated in FIG. 4, the reference engine idle speed decreases at a predetermined rate with a lapse of time after the engine 22 is started. The rate of decrease of the reference engine idle speed is independent of engine temperature. Therefore, the processing operation illustrated in FIG. 3 greatly reduces the likelihood of unstable idling conditions even when the engine temperature changes before the engine 22 is completely warmed-up.

The processing operation illustrated in FIG. 3 sets the target engine idle speed during idle speed running to be the greater of the reference engine idle speed or the input engine idle speed (step S10). Therefore, this processing operation allows the watercraft operator to at least increase the engine idle speed without creating substantial unstable idling conditions, even when the engine 22 is not completely warmed-up.

After the engine 22 has warmed-up completely (step S8), the processing operation illustrated in FIG. 3 sets the input engine idle speed as the target engine idle speed during idle speed running (step S9). Therefore, this processing operation allows the watercraft operator to set the target engine idle speed after substantially stable idling conditions have been established.

Rather than relying on the temperature of the cooling water flowing through the engine 22, the processing operation illustrated in FIG. 3 assumes that the engine warm-up is complete when the reference engine idle speed reaches the preset engine idle speed 106 (step S8). Therefore, this processing operation substantially increases the likelihood that the engine will warm-up completely regardless of any changes in the engine temperature (as approximated by the cooling water temperature) or in the reference engine idle speed at the engine start.

The processing operation illustrated in FIG. 3 sets the reference engine idle speed immediately after an engine start based on the engine temperature (steps S11 and S12). Therefore, this processing operation reduces the likelihood of unstable engine conditions and ensures complete engine warm-up.

When the engine speed is a preset value or higher, the processing operation illustrated in FIG. 3 resets (initializes) the input engine idle speed. Stated otherwise, the input engine idle speed will not be reset unless the preset value is exceeded. Therefore, this processing operation greatly reduces the likelihood that the input engine idle speed will be reset by the watercraft operator. Such resets might ordinarily happen when the operator causes the watercraft 12 to alternately move and stop while looking for a favorable fishing spot, or when the operator runs the watercraft 12 while monitoring the displayed engine speed to maintain it below the preset speed.

When the engine 22 is stopped, the processing operation illustrated in FIG. 3 resets (initializes) the input engine idle speed. This step in the processing operation would require the operator to manually input the desired engine idle speed upon each subsequent starting of the engine 22.

Figure 6:
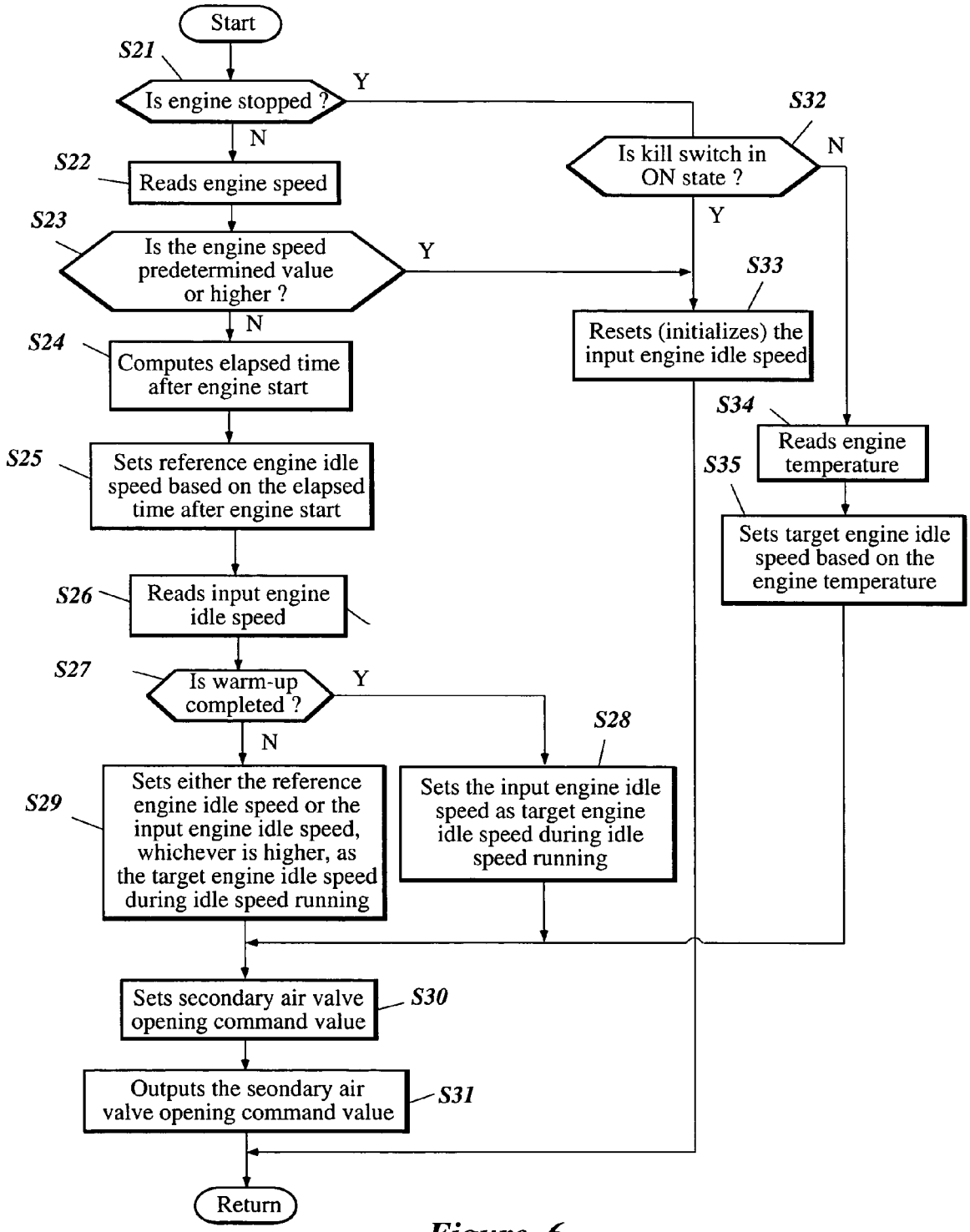
FIG. 6 is a flowchart that diagrams another preferred embodiment of a method for controlling engine idle speed, such as the present engine control system might carry out.

FIG. 6 illustrates another preferred processing operation that computes a secondary air valve opening command value and outputs it as a command signal to the secondary air valve 86. This embodiment is compatible with the general configuration of an outboard motor 10 with a watercraft engine control system illustrated in FIGS. 1 and 2. Further, like the processing operation of FIG. 3, this processing operation also can be executed as a timer interrupt process at intervals of a prescribed sampling time, ΔT. ΔT may equal, for example, approximately 10 milliseconds.

In the flowchart of FIG. 6, many steps are identical to certain steps in the processing operation of FIG. 3. However, the order of steps in FIG. 6 differs from that of FIG. 3. At the first step S21, the ECU 88 determines whether or not the engine 22 is stopped, as with step S1 of FIG. 3. If the engine 22 is stopped, the process goes on to step S32, which is explained in detail below. If the engine 22 is running, the process goes on to step S22.

At step S22, the ECU 88 determines the engine speed, as with step S2 of FIG. 3. Then, the process goes on to step S23. At step S23, the ECU 88 determines whether or not the engine speed read at step S22 is greater than or equal to a predetermined value, as with step S13 of FIG. 3. If the engine speed is greater than or equal to the predetermined value, the process goes on to step S33, which is explained in detail below. If the engine speed is less than the predetermined value, the process goes on to step S24.

At step S24, as with step S5 of FIG. 3, the ECU 88 determines the elapsed time since the last engine start. Then, the process goes on to step S25.

At step S25, as with step S6 of FIG. 3, the ECU 88 computes and sets the reference engine idle speed based on the elapsed time since the last engine start. Then, the process goes on to step S26.

At step S26, the ECU 88 determines the input engine idle speed, as with step S7 of FIG. 3. Then, the process goes on to step S27.

At step S27, as with step S8 of FIG. 3, the ECU 88 determines whether or not the engine 22 is completely warmed-up. Again, this determination is based upon whether or not the reference engine idle speed is equal to the preset engine idle speed. If the engine 22 is completely warmed-up, the process goes on to step S28. If not, the process goes on to step S29.

At step S28, the ECU 88 sets the input engine idle speed read at step S26 as the target engine idle speed during idle speed running, as with step S9 of FIG. 3. Then, the process goes on to step S30.

Meanwhile, at step S29, the ECU 88 sets either the reference engine idle speed set at step S25 or the input engine idle speed read at step S26, whichever is higher, as the target engine idle speed during idle speed running. This step is analogous to step S10 of FIG. 3. Then, the process moves on to step S30.

Meanwhile, if it was determined at step S21 that the engine is stopped, then the process advances to step S32. At step S32, the ECU 88 determines whether or not the engine stop switch, or kill switch, is in an ON state. If the kill switch is in an ON state, the process goes on to step S33. At step S33, the input engine idle speed is reset (initialized). Then, the process returns to the main program. However, If the kill switch is not in an ON state, the process goes on to step S34.

At step S34, the ECU 88 determines the engine temperature, as with step S11 of FIG. 3. Then, the process goes on to step S35.

At step S35, as with step S12 of FIG. 3, the ECU 88 sets a target engine idle speed based on the engine temperature. Then, the process goes on to step S30.

At step S30, as with step S15 of FIG. 3, the ECU 88 sets a secondary air valve opening command value based on the engine speed read at step S22, and the target engine idle speed during idle speed running set at step S28 or step S29, or the target engine idle speed set at step S35. Then, the process goes on to step S31.

At step S31, the ECU 88 outputs the secondary air valve opening command value to the secondary air valve 86, as with step S16 of FIG. 3. Then, the process returns to the main program.

According to this processing operation, the input engine idle speed is reset (initialized) when the engine 22 is stopped and the kill switch is in an ON state. Such conditions prevail when the operator intentionally stops the engine 22. This processing operation reminds the watercraft operator that the input engine idle speed is reset after the engine 22 is intentionally stopped.

The above presents a description of the best mode contemplated for carrying out the present control system for outboard motor, and of the manner and process of making and using it, in such full, clear, concise, and exact terms as to enable any person skilled in the art to which it pertains to make and use this control system. This control system is, however, susceptible to modifications and alternate constructions from that discussed above that are fully equivalent. Consequently, this control system is not limited to the particular embodiments disclosed. On the contrary, this control system covers all modifications and alternate constructions coming within the spirit and scope of the control system as generally expressed by the following claims, which particularly point out and distinctly claim the subject matter of the control system. The steps of the control routines set forth above can be combined, separated, and reordered while still embodying certain features, aspects and advantages of the present invention. Thus, it is intended that the scope of the present invention herein disclosed should not be limited by the particular disclosed embodiments described above, but should be determined only by a fair reading of the claims that follow.

What is claimed is:

1. A control system for a marine engine, the marine engine being adapted to propel a watercraft with thrust produced by an engine-driven propeller, the control system comprising:

an operability sensor adapted to detect whether the watercraft is operable;

at least one engine idle sensor adapted to detect whether the engine is idling;

apparatus adapted to determine an elapsed time after an engine start;

apparatus adapted to determine a reference engine idle speed based on the elapsed time after an engine start, said apparatus including a counter adapted to monitor a number of times that a processing operation is executed and a processor adapted to multiply the number by a preselected sampling interval; and a controller adapted to adjust an engine idle speed during idle speed running based on the reference engine idle speed when the operability sensor detects that the watercraft is operable and the engine idle sensor detects that the engine is idling.

2. The control system of claim 1, wherein the operability sensor comprises a shift switch position sensor.

3. The control system of claim 1, wherein the engine idle sensor comprises a throttle opening sensor.

4. The control system of claim 1, wherein the apparatus adapted to determine an elapsed time after an engine start comprises a timer.

5. The control system of claim 1, wherein the controller is adapted to control the opening and closing of a secondary air valve.

6. A control system for a marine engine, the marine engine being adapted to propel a watercraft with thrust produced by an engine-driven propeller, the control system comprising:

an operability sensor adapted to detect whether the watercraft is operable;

at least one engine idle sensor adapted to detect whether the engine is idling;

apparatus adapted to determine an elapsed time after an engine start;

apparatus adapted to determine a reference engine idle speed based on the elapsed time after an engine start;

a controller adapted to adjust an engine idle speed during idle speed running based on the reference engine idle speed when the operability sensor detects that the watercraft is operable and the engine idle sensor detects that the engine is idling; and an engine idle speed control switch adapted to enable a watercraft operator to manually input an engine idle speed.

7. The control system of claim 6, wherein, during idle speed running, the engine idle speed controller is adapted to set either the input engine idle speed or the reference engine idle speed, whichever is higher, as a target engine idle speed until an engine warm-up is completed.

8. The control system of claim 6, wherein, during idle speed running, the engine idle speed controller is adapted to set the input engine idle speed as a target engine idle speed after an engine warm-up is completed.

9. A control system for a marine engine, the marine engine being adapted to propel a watercraft with thrust produced by an engine-driven propeller, the control system comprising:

an operability sensor adapted to detect whether the watercraft is operable;

at least one engine idle sensor adapted to detect whether the engine is idling;

apparatus adapted to determine an elapsed time after an engine start;

apparatus adapted to determine a reference engine idle speed based on the elapsed time after an engine start;

a controller adapted to adjust an engine idle speed during idle speed running based on the reference engine idle speed when the operability sensor detects that the watercraft is operable and the engine idle sensor detects that the engine is idling;

an engine idle speed control switch adapted to enable a watercraft operator to manually input an engine idle speed; and an engine speed sensor adapted to detect an engine speed;

wherein, when the engine speed equals a predetermined speed or higher, the control system is adapted to reset the input engine idle speed.

10. A control system for a marine engine, the marine engine being adapted to propel a watercraft with thrust produced by an engine-driven propeller, the control system comprising:

an operability sensor adapted to detect whether the watercraft is operable;

at least one engine idle sensor adapted to detect whether the engine is idling;

apparatus adapted to determine an elapsed time after an engine start;

apparatus adapted to determine a reference engine idle speed based on the elapsed time after an engine start;

a controller adapted to adjust an engine idle speed during idle speed running based on the reference engine idle speed when the operability sensor detects that the watercraft is operable and the engine idle sensor detects that the engine is idling;

an engine idle speed control switch adapted to enable a watercraft operator to manually input an engine idle speed; and an engine speed sensor adapted to detect an engine speed;

wherein, when the engine is stopped, the control system is adapted to reset the input engine idle speed.

11. A control system for a marine engine, the marine engine being adapted to propel a watercraft with thrust produced by an engine-driven propeller, the control system comprising:

an operability sensor adapted to detect whether the watercraft is operable;

at least one engine idle sensor adapted to detect whether the engine is idling;

apparatus adapted to determine an elapsed time after an engine start;

apparatus adapted to determine a reference engine idle speed based on the elapsed time after an engine start; and a controller adapted to adjust an engine idle speed during idle speed running based on the reference engine idle speed when the operability sensor detects that the watercraft is operable and the engine idle sensor detects that the engine is idling;

wherein, during idle speed running, the engine idle speed controller is adapted to assume that an engine warm-up is completed when the reference engine idle speed equals a predetermined engine idle speed.

12. The control system of claim 11, further comprising an engine temperature sensor adapted to detect an engine temperature.

13. The control system of claim 12, wherein, immediately after an engine start, the apparatus adapted to determine a reference engine idle speed is adapted to set the reference engine idle speed based on the engine temperature.

14. A marine engine for a watercraft comprising:

an engine body defining at least one cylinder bore in which a piston reciprocates;

a cylinder head secured to a first end of the engine body for closing the cylinder bore and defining with the piston and the cylinder bore a combustion chamber;

an intake passage in selective fluid communication with the combustion chamber and configured to provide air for an air/fuel mixture to the combustion chamber;

an air induction system configured to supply air to the intake passage;

at least one sensor configured to monitor engine running conditions; and an engine control unit configured to determine an elapsed time after an engine start and further configured to control an engine idle speed based upon the engine running conditions and the elapsed time;

wherein the engine control unit is further configured to compare a reference engine idle speed to a preset engine idle speed, and still further configured to control an actual engine idle speed based upon relative values of the reference engine idle speed and the preset engine idle speed.

15. The marine engine of claim 14, wherein the air induction system comprises a throttle valve configured to regulate an air flow into the intake passageway.

16. The marine engine of claim 14, wherein the air induction system further comprises a secondary air valve configured to selectively supplement the air flow into the intake passageway.

17. The marine engine of claim 14, wherein the engine control unit controls the engine idle speed by controlling an opening or closing of the secondary air valve.

18. A method of operating an outboard motor for a watercraft, the outboard motor comprising an engine for driving a marine propulsion device, the method comprising:

determining at least one actual engine running condition;

determining an elapsed time after an engine start;

setting a reference engine idle speed based at least in part upon the elapsed time;

reading an input engine idle speed;

comparing the reference engine idle speed to a preset engine idle speed;

setting a target engine idle speed to be one of the reference engine idle speed and the input engine idle speed; and adjusting an actual engine idle speed to be equal to the target engine idle speed.

19. The method of claim 18, wherein the target engine idle speed is set to the reference engine idle speed if the reference engine idle speed is greater than the preset engine idle speed and the reference engine idle speed is greater than the input engine idle speed.

20. The method of claim 18, wherein the target engine idle speed is set to the input engine idle speed if the reference engine idle speed is greater than the preset engine idle speed and the input engine idle speed is greater than the reference engine idle speed.

21. The method of claim 18, wherein the target engine idle speed is set to the input engine idle speed if the reference engine idle speed is equal to the preset engine idle speed.

22. The method of claim 18, wherein adjusting the actual engine idle speed comprises setting a secondary air valve opening command value.

23. The method of claim 22, wherein adjusting the actual engine idle speed further comprises outputting the secondary air valve opening command value.

24. The method of claim 18, wherein the engine running condition is whether the engine is idling and target engine idle speed is set to be the reference engine idle speed if the engine is determined to be idling and an associated transmission is not in neutral.

25. The method of claim 18, wherein the target engine idle speed is reset to the reference engine idle speed if a sensed engine speed exceeds a preset threshold speed.

26. The method of claim 18, wherein the target engine idle speed is reset to the reference engine idle speed if the engine is stopped.

* * * * *